US005315778A

United States Patent [19]

Wolford

[11] Patent Number: 5,315,778

[45] Date of Patent: May 31, 1994

[54] FIREARM CHAMBER PLUG

[76] Inventor: Craig F. Wolford, Rt. 1, Box 178, Pine Wood, S.C. 29125

[21] Appl. No.: 75,610

[22] Filed: Jun. 14, 1993

[51] Int. Cl.[5] ..... F41A 17/44

[52] U.S. Cl. ..... 42/70.11; 102/511

[58] Field of Search ..... 42/70.11, 70.01, 96, 42/1.05; 102/511

[56] References Cited

U.S. PATENT DOCUMENTS

| | | | |
|---|---|---|---|
| 41,115 | 1/1864 | Bean | 42/70.11 |
| 407,890 | 7/1889 | Day | 102/511 |
| 2,398,895 | 4/1946 | Schreib | 102/511 |
| 2,530,560 | 11/1950 | Young | 42/70.11 |
| 2,923,323 | 2/1960 | Franck | 42/70.11 |
| 3,154,874 | 11/1964 | Stewart | 42/70.11 |
| 3,710,490 | 1/1973 | Cornett et al. | 42/70.11 |
| 4,479,320 | 10/1984 | Fix | 42/70.11 |
| 5,048,211 | 9/1991 | Hepp | 42/70.11 |
| 5,179,234 | 1/1993 | Cvetanovich | 42/70.11 |

*Primary Examiner*—Stephen M. Johnson
*Attorney, Agent, or Firm*—Leon Gilden

[57] ABSTRACT

A chamber plug is arranged to include a forward chamber cylinder removably mounted relative to a rear chamber cylinder in coaxially aligned relationship utilizing an elongate fastener, wherein the elongate fastener is accessed through a wrench member as the fastener projects through the nose portion of the forward cylinder. A rubber "O" ring washer grommet projects laterally beyond the side portion of the assembled chamber plug serving as a friction material to position the chamber plug in place when tightened.

2 Claims, 4 Drawing Sheets

FIREARM CHAMBER PLUG

BACKGROUND OF THE INVENTION

1. Field of the Invention

The field of invention relates to firearm locking structure, and more particularly pertains to a new and improved firearm chamber plug arranged to position a chamber plug within each chamber of an associated firearm.

2. Description of the Prior Art

Firearms of various types and their accidental discharge resulting in injury and death requires the utilization of various locking structure. Various chamber plug members utilized in the prior art are exemplified in U.S. Pat. Nos. 4,908,971; 4,965,952; and 3,444,639.

The U.S. Pat. Nos. 5,038,508 and 5,048,211 are examples of components arranged for positioning within the bore and chamber portion of a firearm.

The instant invention sets forth an organization to overcome deficiencies of the prior art by utilizing a separable member arranged for ease of use as well as effectiveness in construction for positioning within a chamber of an associated firearm and further permitting adaption for use in auto-loading type firearm chambers by employing a projecting flange projecting laterally beyond a rear end portion of the chamber plug that is rotatable into operative engagement with an extractor finger of a firearm to force the chamber plate of the invention for securement relative to the extractor finger and permit cycling of the unloading chamber without removal of the plug therefrom and in this respect, the present invention substantially fulfills this need.

SUMMARY OF THE INVENTION

In view of the foregoing disadvantages inherent in the known types of firearm safety structure now present in the prior art, the present invention provides a firearm chamber plug wherein the same is arranged for positioning within a firearm chamber preventing access to positioning of a loaded round within the chamber. As such, the general purpose of the present invention, which will be described subsequently in greater detail, is to provide a new and improved firearm chamber plug which has all the advantages of the prior art firearm safety apparatus and none of the disadvantages.

To attain this, the present invention provides a chamber plug arranged to include a forward chamber cylinder removably mounted relative to a rear chamber cylinder in coaxially aligned relationship utilizing an elongate fastener, wherein the elongate fastener is accessed through a wrench member as the fastener projects through the nose portion of the forward cylinder. A rubber "O" ring washer grommet projects laterally beyond the side portion of the assembled chamber plug serving as a friction material to position the chamber plug in place when tightened.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved firearm chamber plug which has all the advantages of the prior art firearm safety apparatus and none of the disadvantages.

It is another object of the present invention to provide a new and improved firearm chamber plug which may be easily and efficiently manufactured and marketed.

It is a further object of the present invention to provide a new and improved firearm chamber plug which is of a durable and reliable construction.

An even further object of the present invention is to provide a new and improved firearm chamber plug which is susceptible of a low cost of manufacture with regard to both materials and labor, and which accordingly is then susceptible of low prices of sale to the consuming public, thereby making such firearm chamber plugs economically available to the buying public.

Still yet another object of the present invention is to provide a new and improved firearm chamber plug which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
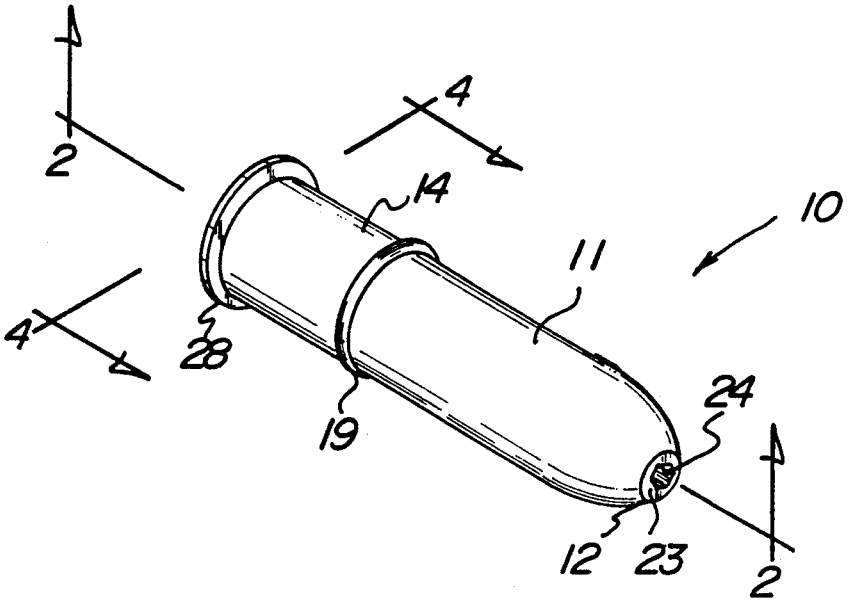
FIG. 1 is an isometric illustration of the instant invention.
Figure 2:
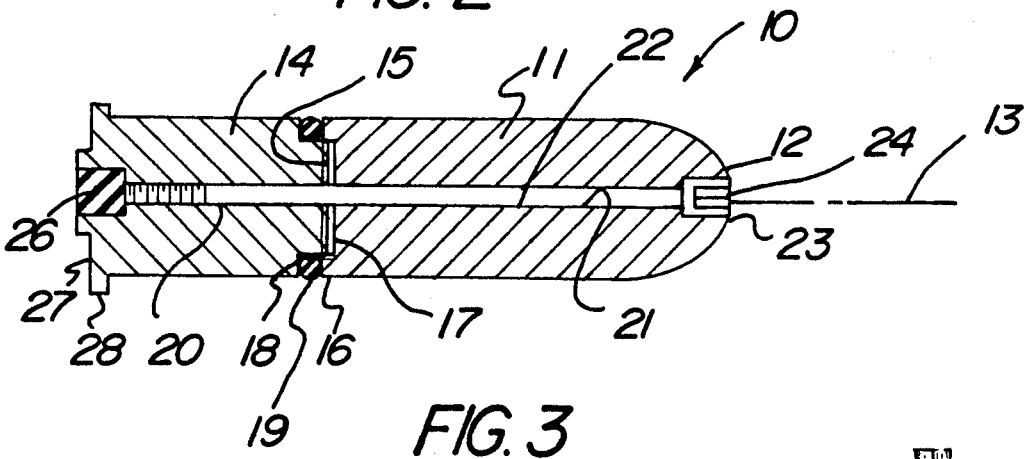
FIG. 2 is an orthographic view, taken along the lines 2—2 of FIG. 1 in the direction indicated by the arrows.
Figure 3:
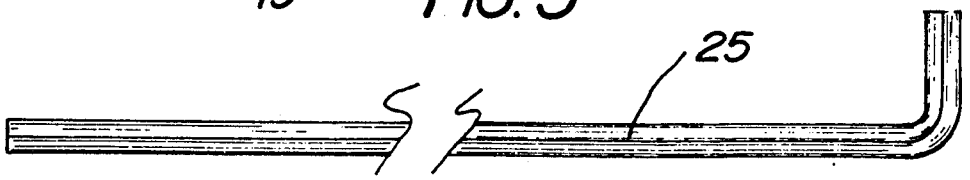
FIG. 3 is an orthographic view of the wrench structure utilized in association with either a revolver or auto pistol chamber plug of the instant invention.

With reference now to the drawings, and in particular to FIGS. 1 to 12 thereof, a new and improved firearm chamber plug embodying the principles and concepts of the present invention and generally designated by the reference numeral 10 will be described.

Figure 4:
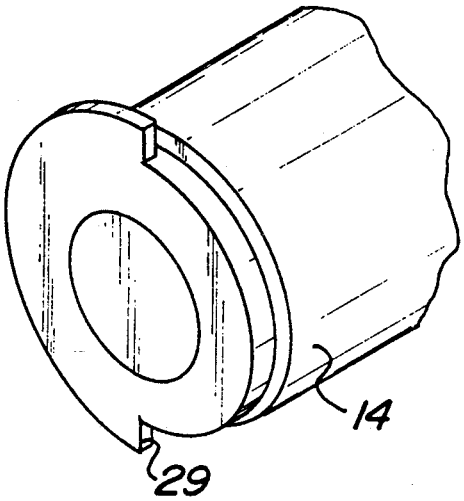
FIG. 4 is an orthographic view, taken along the lines 4—4 of FIG. 1 in the direction indicated by the arrows.
Figure 5:
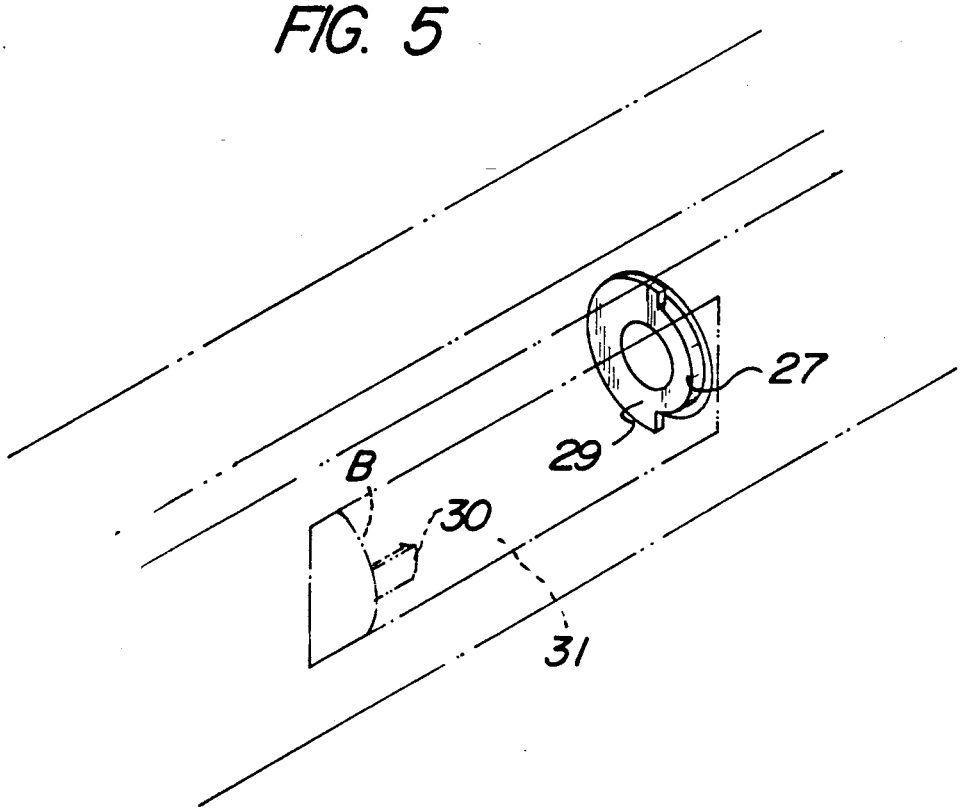
FIG. 5 is an isometric illustration of the invention relative to an extractor lever within a firearm chamber.

More specifically, the firearm chamber plug 10 of the instant invention essentially comprises a forward chamber cylinder 11 mounted to and coaxially aligned along a central axis 13 to a rear chamber cylinder 14. The forward chamber cylinder 11 is formed with a semi-cylindrical nose 12 for ease of insertion within a firearm chamber. The forward chamber cylinder 11 includes a forward cylinder rear face 15 orthogonally oriented relative to the axis 13, having a forward cylinder annular flange 16 and a forward cylinder rear face 15 recessed along the axis 13 relative to the flange 16. The forward cylinder annular flange 16 is arranged to receive for alignment and locking the rear cylinder forward hub 17, with a rear cylinder annular seat 18 receiving an "O" ring 19 that is in turn oriented between the annular seat 18 and the forward cylinder annular flange 16. An elongate fastener shank 22 having a fastener shank head 23 positioned within the semi-cylindrical nose 12 is directed along the axis 13 through the forward cylinder 11 and threadedly received within the rear chamber cylinder 14. Tightening of the fastener shank 22 into the threaded rear cylinder threaded bore 20 and directed through the forward cylinder bore 21 effects drawing of the annular flange 16 and the annular seat 18 towards one another to compress the "O" ring 19 and project the same beyond the lateral sides of the forward and rear chamber cylinders 11 and 14 that are of an equal predetermined diameter. This is arranged to substantially lock the plug within an associated firearm chamber. Additionally, a firing pin cushion 26 may be mounted coaxially within a rear cylinder rear face 27 having an annular chamber lip 28 extending laterally beyond the rear chamber cylinder 14, with the annular chamber lip 28 of a further predetermined diameter greater than the predetermined diameter. The annular lip 28 may be formed as a semi-annular lip 29, in a manner as indicated in FIG. 4, for use with auto-loading devise 22. When the rear cylinder rear face 27 is in abutment with the bolt "B" of the firearm, as indicated in FIG. 5.

Figure 6:
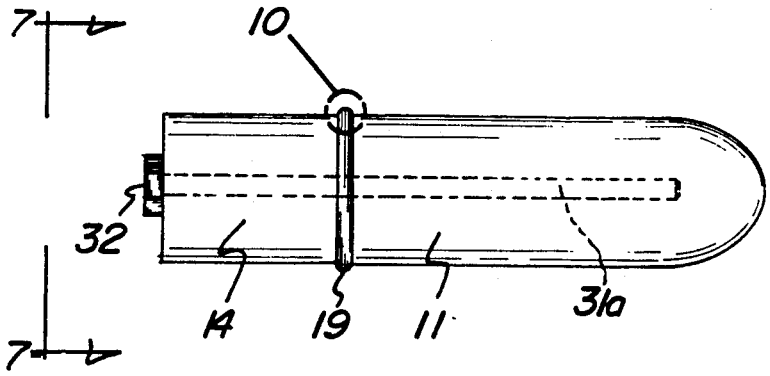
FIG. 6 is an orthographic view of a chamber plug structure of the invention for use within a rifle or shotgun chamber.
Figure 7:
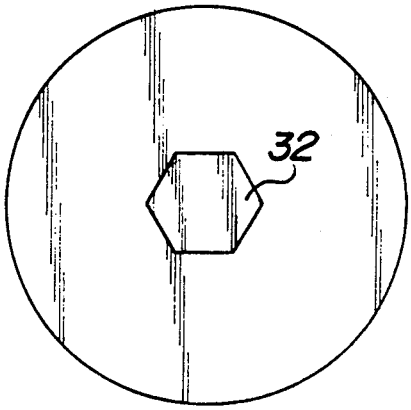
FIG. 7 is an orthographic view, taken along the lines 7—7 of FIG. 6 in the direction indicated by the arrows.
Figure 8:
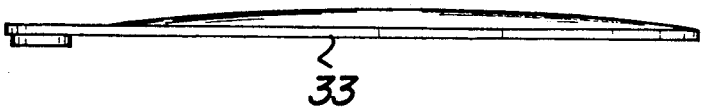
FIG. 8 is an orthographic side view of a wrench structure for use with the plug of FIG. 6.
Figure 9:
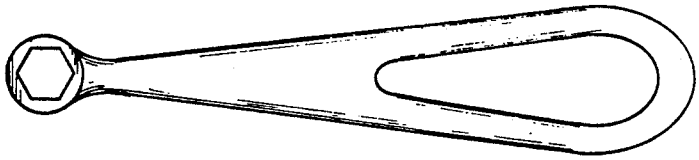
FIG. 9 is an orthographic top view of the wrench structure for use with the plug of FIG. 6.

The FIG. 6 indicates the use of a plug assembly, wherein a polygonal fastener head 32 cooperates with a fastener shank 31*a* directed into the plug and the forward and rear cylinders 11 and 14 through the rear cylinder rear face 27 for ease of access. Rotation of such may be accomplished by utilizing a wrench structure 33 grasping the fastener head 32 circumferentially.

Figure 10:
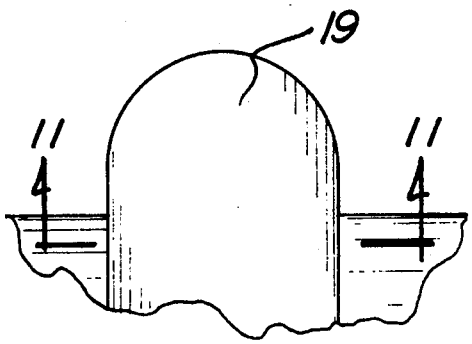
FIG. 10 is an orthographic view of the "O" ring structure as utilized by the invention.
Figure 11:
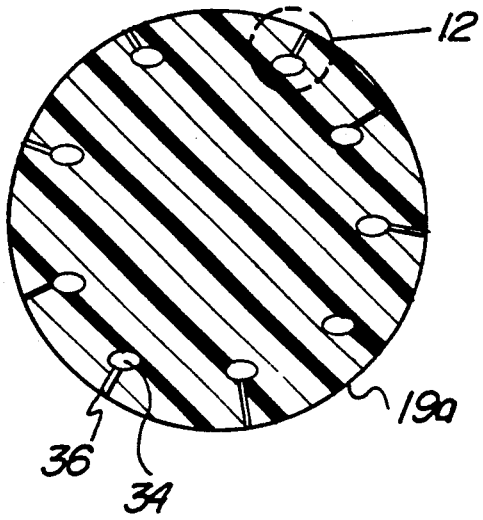
FIG. 11 is an orthographic view, taken along the lines 11—11 of FIG. 10 of the direction indicated by the arrows.
Figure 12:
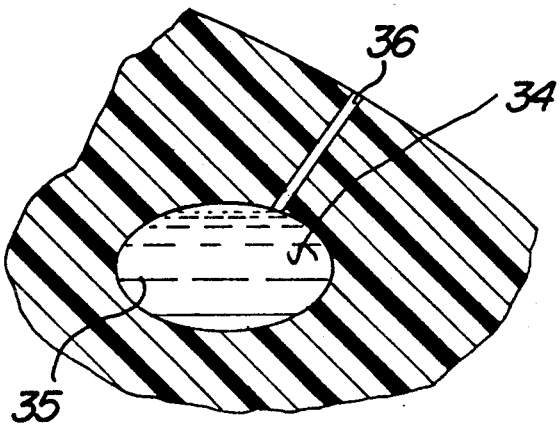
FIG. 12 is an enlarged orthographic view of section 12 as set forth in FIG. 11.

The FIGS. 10-12 indicates the use of the "O" ring 19 formed to include a plurality of annular arrays of fluid chambers 34 within the "O" ring recessed within the "O" ring and in communication within an exterior periphery of the "O" ring by utilization of conduits 36. A gun oil lubricant fluid 35 is contained within each fluid chamber 34, whereupon compressing of the "O" ring effects projecting of the lubricant oil or fluid from within each associated fluid chamber 34 for lubricating chambers and protecting same from corrosion during extended periods of storage of the plug 10 within the associated firearm chamber.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A firearm chamber plug, comprising, an elongate forward chamber cylinder coaxially aligned with a rear chamber cylinder, wherein the forward chamber cylinder and the rear chamber cylinder are oriented about a predetermined axis, the forward chamber cylinder including a forward cylinder rear face having an annular flange projecting axially beyond the forward cylinder rear face peripherally about the forward cylinder rear face, and the rear chamber cylinder having a forward hub aligned along said predetermined axis, with an annular seat oriented peripherally about the forward hub, with the annular seat aligned with the annular flange, and an "O" ring positioned between the annular seat and the annular flange, with the annular flange recessed relative to the forward hub, and a fastener directed through the forward chamber cylinder and threadedly received within the rear chamber cylinder, having a fastener head oriented within the forward cylinder forward end and the fastener having a fastener shank integral with the fastener head, wherein the fastener shank is directed through the forward cylinder and threadedly received within the rear chamber cylinder, said fastener shank being aligned along said predetermined axis, whereupon rotation of the fastener shank relative to the forward chamber cylinder and rear chamber cylinder effects projecting the rear cylinder forward hub within the annular flange with resultant squeezing of the "O" ring laterally beyond the side walls of the forward chamber cylinder and the rear chamber cylinder for engagement with a firearm chamber, and the rear chamber cylinder includes a rear cylinder rear face orthogonally oriented relative to the predetermined axis, and a semi-annular lip extending laterally beyond the rear cylinder rear face coplanar therewith, whereupon rotation of the rear chamber cylinder permits engagement of the semi-annular lip with an extractor lever within a gun chamber, with the rear chamber cylinder rear face arranged for positioning in adjacency to a firearm bolt member.

2. A firearm chamber plug as set forth in claim 1 wherein the "O" ring includes at least one annular array of fluid chambers positioned within the "O" ring spaced from an outer periphery of the "O" ring, wherein each said fluid chamber is in communication with the outer periphery of the "O" ring, to include a respective conduit in communication with each said fluid chamber and the outer periphery of the "O" ring, with each said fluid chamber including a gun lubrication fluid therewithin, whereupon directing the annular seat towards the annular flange compresses the "O" ring and projects the lubricant fluid from each said fluid chamber to the outer periphery of the "O" ring.

* * * * *